US005949014A

United States Patent [19]

Rashak et al.

[11] Patent Number: 5,949,014

[45] Date of Patent: Sep. 7, 1999

[54] EXCHANGEABLE STACKED PICKUP ASSEMBLY FOR STRINGED INSTRUMENTS

[76] Inventors: Glen Rashak, 5542 Michael St., San Diego, Calif. 92105; Eric W. B. Anderson, 3 Larks Aire Pl., The Woodlands, Tex. 77381

[21] Appl. No.: 09/040,481

[22] Filed: Mar. 17, 1998

[51] Int. Cl.[6] ..... G10H 3/18

[52] U.S. Cl. ..... 84/725; 84/723; 84/726; 84/743; 84/DIG. 24

[58] Field of Search ..... 84/723, 725–728, 84/730, 731, DIG. 24, 743

[56] References Cited

U.S. PATENT DOCUMENTS

| | | | |
|---|---|---|---|
| 4,220,069 | 9/1980 | Fender | 84/1.15 |
| 5,168,117 | 12/1992 | Anderson | 84/726 |
| 5,221,805 | 6/1993 | Lace | 84/726 |

*Primary Examiner*—William M. Shoop, Jr.
*Assistant Examiner*—Marlon T. Fletcher
*Attorney, Agent, or Firm*—Steins & Associates

[57] ABSTRACT

An Exchangeable Stacked Pickup Assembly for Stringed Instruments is disclosed. The preferred system and assembly permit the user to change magnet characteristics and/or the number of coil windings without necessitating string removal and subsequent guitar re-tuning. The pickup system further includes a lower coil assembly for attaching to the face of a guitar or other stringed instrument, and an upper coil assembly for attaching to, and detaching from the lower coil assembly. As described, the lower coil assembly and the upper coil assembly include conventional pickup coil assemblies, which are in electrical circuit when attached to one another. Furthermore, the preferred system includes a variety of upper coil assemblies, each having unique electromagnetic qualities, such that the user need only exchange one upper coil assembly with another in order to effect a desired change in sound to the stringed instrument.

17 Claims, 8 Drawing Sheets

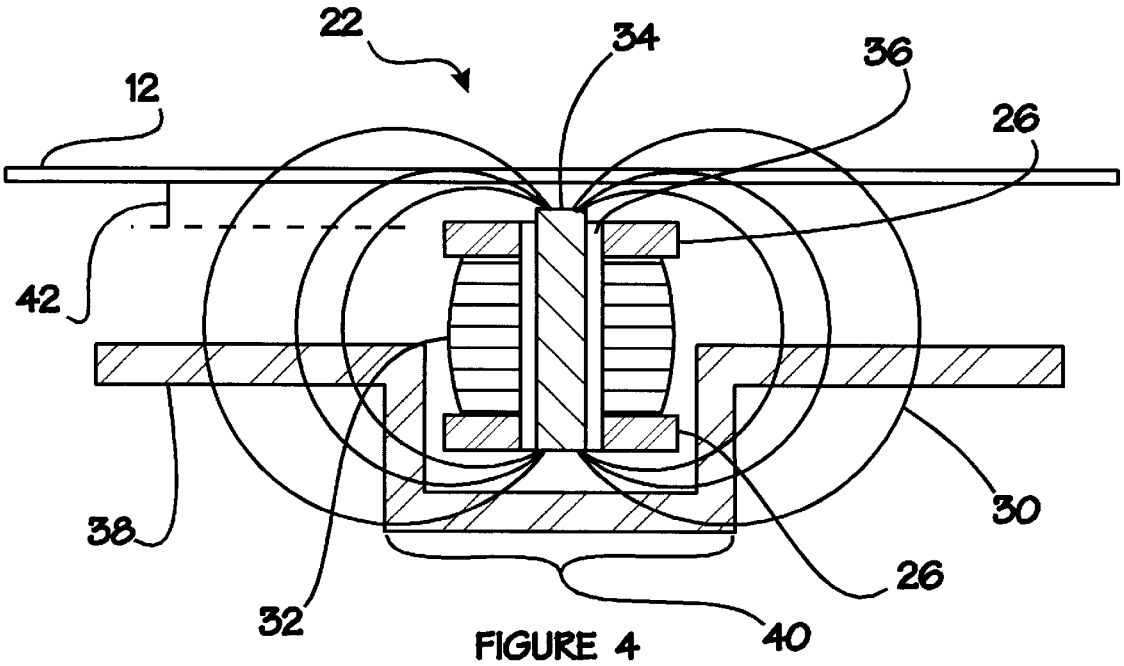
FIGURE 4
Prior Art
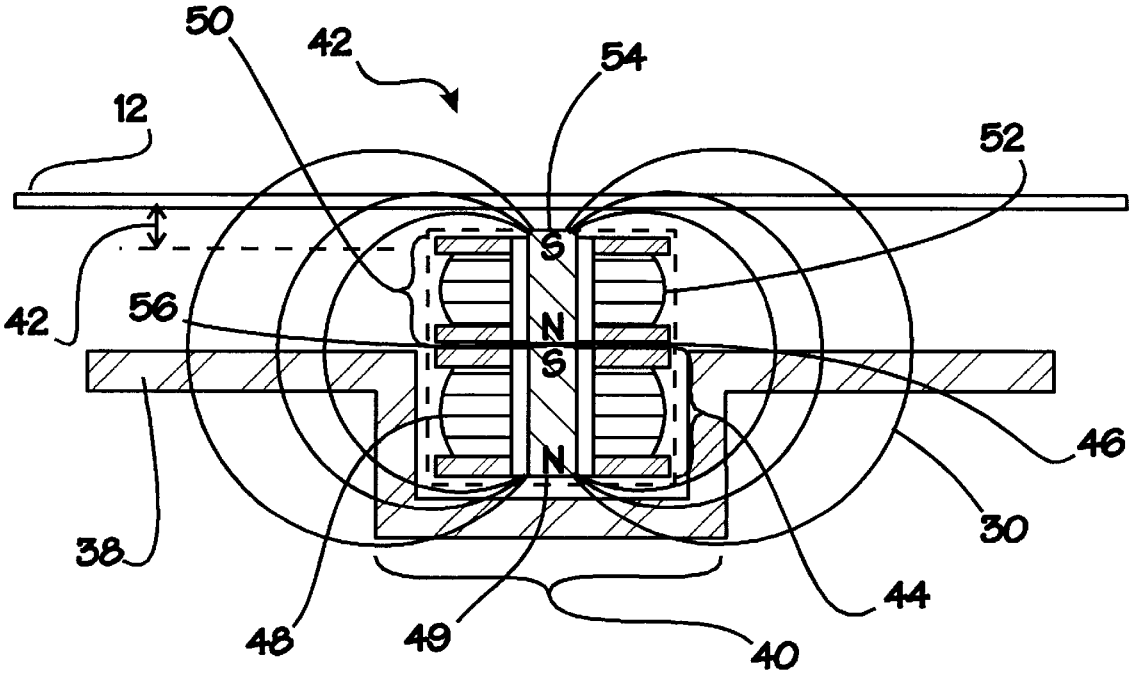
FIIGURE 5

EXCHANGEABLE STACKED PICKUP ASSEMBLY FOR STRINGED INSTRUMENTS

BACKGROUND OF THE INVENTION

1. Field of the Invention

This invention relates generally to the amplification of stringed instruments and, more specifically, to an Exchangeable Stacked Pickup Assembly and Installation for Stringed Instruments.

2. Description of Related Art

Electromagnetic field-type pickups have been available for stringed instruments for a number of years. In the case of guitars, virtually every contemporary musical group uses one or more guitars equipped with an electromagnetic pickup. In fact, many musicians own more than one model or type of "electric guitar" in order to obtain different sounds for different musical pieces. Alternatively, the musician may have guitars of the same model, but with different electromagnetic pickups in each. It is this necessity for different guitars to obtain different sounds that is the focus of the present invention.

FIG. 1 depicts a conventional electric guitar 10. While available in a wide variety of configurations, the typical electric guitar 10 design includes a plurality of typically metallic strings 12 running from the head 14 to the bridge assembly 16. The strings 12 are located cooperatively with one or more pickups 18, such that the pickups 18 will detect vibrations in the strings 12 and convert these vibrations into an electrical current for external amplification and other adjustments.

FIGS. 2A–2D depict common designs for pickups 18. FIG. 2A depicts a conventional single coil pickup 20. Located within the pickup 20 is a single electromagnetic coil 22 and a plurality of pole pieces 28, creating a magnetic field therein. FIG. 2B shows a conventional dual coil pickup 24, having a pair of coils 22. As shown in FIG. 1, the pickups 20 and 24 can be oriented in various positions in relation to the strings (see FIG. 1). FIG. 2C shows a single coil pickup 20, similar to the pickup of FIG. 2A, but with a single bar magnet 23 in place of the plurality of pole pieces 28. FIG. 2D shows a double coil 29, in which there is a single coil winding 32, separated by insulating pieces 26, and in which there may be two different types of magnets 23.

Now turning to FIG. 3, we might better appreciate a common prior coil 22. As can be seen, this coil 22 comprises a pair of insulating plates 26 through which a plurality of pole pieces 28 pass. In this design, the pole pieces 28 are magnetized such that either end has opposite polarity. The polarity arrangement will create a magnetic field between the ends of the pole pieces 28, depicted by the field lines 30. It should be appreciated that the strings 12 pass through the magnetic field lines 30 as they pass over the coil 22. Not all pole pieces 28 have the same magnetic qualities; different magnetic characteristics and/or materials will result in different fields 30 (or field strengths) for each particular string 12 and pole piece 28 combination. The coil 22 also has coil windings 32, which are, essentially, formed from a thin, continuous wire wrapped around the pole pieces 28. The coil windings 32 pass through magnetic fields 30 of all of the pole pieces 28, and could be made from a variety of metallic materials, depending upon the desired sound.

In operation, therefore, vibrations of each metallic string 12 will create fluctuations in the magnetic field 30 of the associated pole piece 28. Fluctuations in magnetic field lines 30 are well known to create electromotive forces resulting in electrical current in any electrical wires located in and perpendicular to the field lines 30. As a result, the vibrations created when a musician strums the strings 12 will cause fluctuations in the magnetic fields 30 associated with that string 12, and a current or voltage will be created in the coil windings 32 that is then used by amplifiers and other devices to produce external sound through speakers.

FIG. 4 gives further detail regarding the prior art. FIG. 4 is a cutaway side view of the coil 22 of FIG. 3 as it might be installed within an electric guitar. As can be seen, the pole pieces (see FIG. 3) typically comprise a pole core 34 sheathed in a pole insulator 36, both of them passing through the two insulating plates 26. It should be appreciated that the pole insulator 36 and insulating plates 26 may be combined into a single frame for the coil windings 32 (known as a "bobbin"). The coil 22 is either surface mounted on the face of the guitar 38, or it may be located in a recess 40 formed within the face 38, depending upon the particular guitar design. The coil 22 is installed such that the pole distance 42 is adequate for the strings 12 to vibrate freely, while also providing optimum sound output; this distance 42 is determined by the guitar design, and may be adjusted to some extent by the musician.

It can be easily understood that different numbers of coil windings 32 (and therefore wire lengths) that are on the coil 22 will result in a different characteristic sound for that particular coil 22. It should be appreciated that the pole distance 42 is insufficient to permit the coil 22 to be removed without first removing the strings 12. This can be a very time-consuming process, which is why musicians maintain more than one guitar. The design depicted in FIGS. 3–4 are exemplary only; a wide variety of other designs are known, including designs that combine insulating pole pieces 28 and magnets located elsewhere in the coil 22. What all have in common, however, is that the amplification of the sound is created by currents or voltages created in the coil windings 32, and that to change the guitar's sound characteristics, one must change either the magnetic qualities of the pickup or the number of windings in the coil 22, or both.

What is needed, therefore, is a pickup system for stringed musical instruments that permits the user to change magnet characteristics and/or the number of coil windings without necessitating string removal and subsequent guitar re-tuning.

Lace, U.S. Pat. No. 5,221,805 sought to solve this problem. The Lace device is, essentially, a secondary magnet that is added on to the top of an existing pickup. Lace states that the "add-on device . . . modifies the operating characteristics . . . of the output signal of an electromagnetic pickup" by changing the apparent characteristics of the pickup's magnetic field. The problem with the Lace device is that it is limited in its range. While changing the characteristics of the magnetic fields should result in some change in the output signal, it will not permit the large changes available by changing the number of coil windings, the coil wire diameter, or the coil wire material. If a musician could change either the magnetic field or the coil characteristics (i.e. number of windings, wire diameter or material), or both, without needing to re-string the musical instrument, that musician would truly be able to obtain virtually any desired sound out of a single musical instrument.

SUMMARY OF THE INVENTION

In light of the aforementioned problems associated with the prior devices, it is an object of the present invention to provide an Exchangeable Stacked Pickup Assembly and Installation for Stringed Instruments. It is a further object that the system and assembly permit the user to change magnet characteristics and/or the number of coil windings without necessitating string removal and subsequent guitar re-tuning. It is a still further object that the pickup system include a lower coil assembly for attaching to the face of a guitar, and an upper coil assembly for attaching to, and detaching from the lower coil assembly. It is an object that both the lower coil assembly and the upper coil assembly include conventional pickup coil assemblies, and that they are in electrical circuit when attached to one another. It is another object that the preferred system include a variety of upper coil assemblies, each having unique electromagnetic qualities, such that the user need only exchange one upper coil assembly with another in order to effect a desired change in sound to the stringed instrument.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

FIG. 4 is a cutaway side view of the coil of FIG. 3 as it might be installed within an electric guitar;

FIG. 5 is a cutaway side view of a preferred embodiment of a stacked single coil pickup of the present invention;

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide an Exchangeable Stacked Pickup Assembly for Stringed Instruments.

Figure 3:
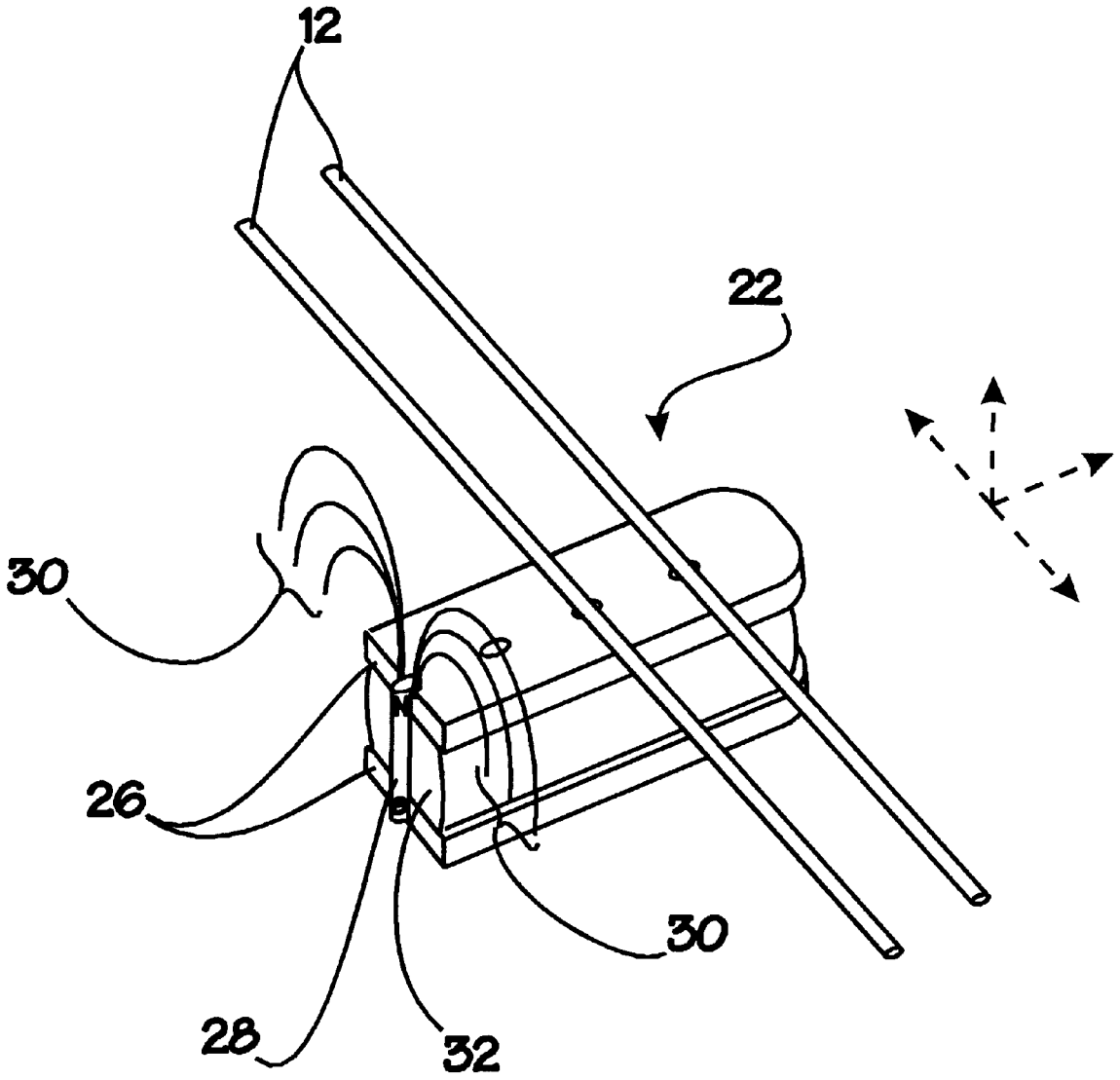
FIGURE 3 Prior Art
FIG. 3 is a partial cutaway perspective view of a coil of a conventional pickup.

The present invention can best be understood by initial consideration of FIG. 5. FIG. 5 is a cutaway side view of a preferred embodiment of a stacked single coil pickup 42 of the present invention. The example shown might be used to replace the prior coil shown in FIG. 4. In its depicted form, the stacked single coil pickup 42 comprises a lower coil 44 which is attached to the face of the guitar 38, such as in the recess 40 shown. The lower coil 44 has many components in common with the prior coils (see FIGS. 3 and 4), including the insulating plates and pole insulators (not labeled, see FIGS. 3 and 4). What is unique about the lower coil 44 is that it has an upper surface configured with a winding contact 46. The winding contact 46 is, in its preferred form, a metallic contact pad that is in electrical circuit with the lower coil windings 48. Also included in the lower coil 44 is a lower pole core 49, which may be configured as with the prior devices heretofore described. Furthermore, the lower coil 44 is configured to be shorter than the prior art coil (see FIG. 4).

Attached to the top of the lower coil 44 is an upper coil 50, which may be very similar to the lower coil 44, in that it has a conventional design, such as insulating plates and pole insulators (not labeled, see FIGS. 3 and 4), upper coil windings 52 and an upper pole core 54. What is unique about the upper coil 50 is that it includes an upper winding contact 56 on its bottom that is in electrical circuit with the upper coil windings 52. The lower winding contact 46 and the upper winding contact 56 are configured such that they meet and complete an electrical connection when the upper coil 50 is attached to the top of the lower coil 44. Once connected, the upper coil 50 and lower coil 44 create, in effect, a single coil. If the magnetic characteristics of the stacked coil pickup 42 are identical in the combination to the coil 22 shown in FIG. 4, and if the total wire length of the lower coil windings 48 plus the upper coil windings 52 equal the wire length of the coil windings 32 of the coil 22 of FIG. 4, then the magnetic field 30 of the stacked pickup 42 and output response of the stacked pickup 42 should be identical to the prior pickup 22 of FIG. 4.

What makes this design so powerful and unique is the ability to exchange the upper coil 50 with an alternative upper coil 50 that has different magnetic and/or coil winding 52 characteristics. Changes in these characteristics will result in changes in the output signal of the pickup 42, and consequently, changes in the sound characteristics of the guitar. It should be appreciated that each different upper coil 50 is designed to be attachable and detachable from the lower coil 44 while not altering the pole distance 42, and without requiring removal of the strings 12. Further detail in regard to the installation and removal of the upper coils 50 is provided below in connection with FIGS. 6–10.

Figure 1:
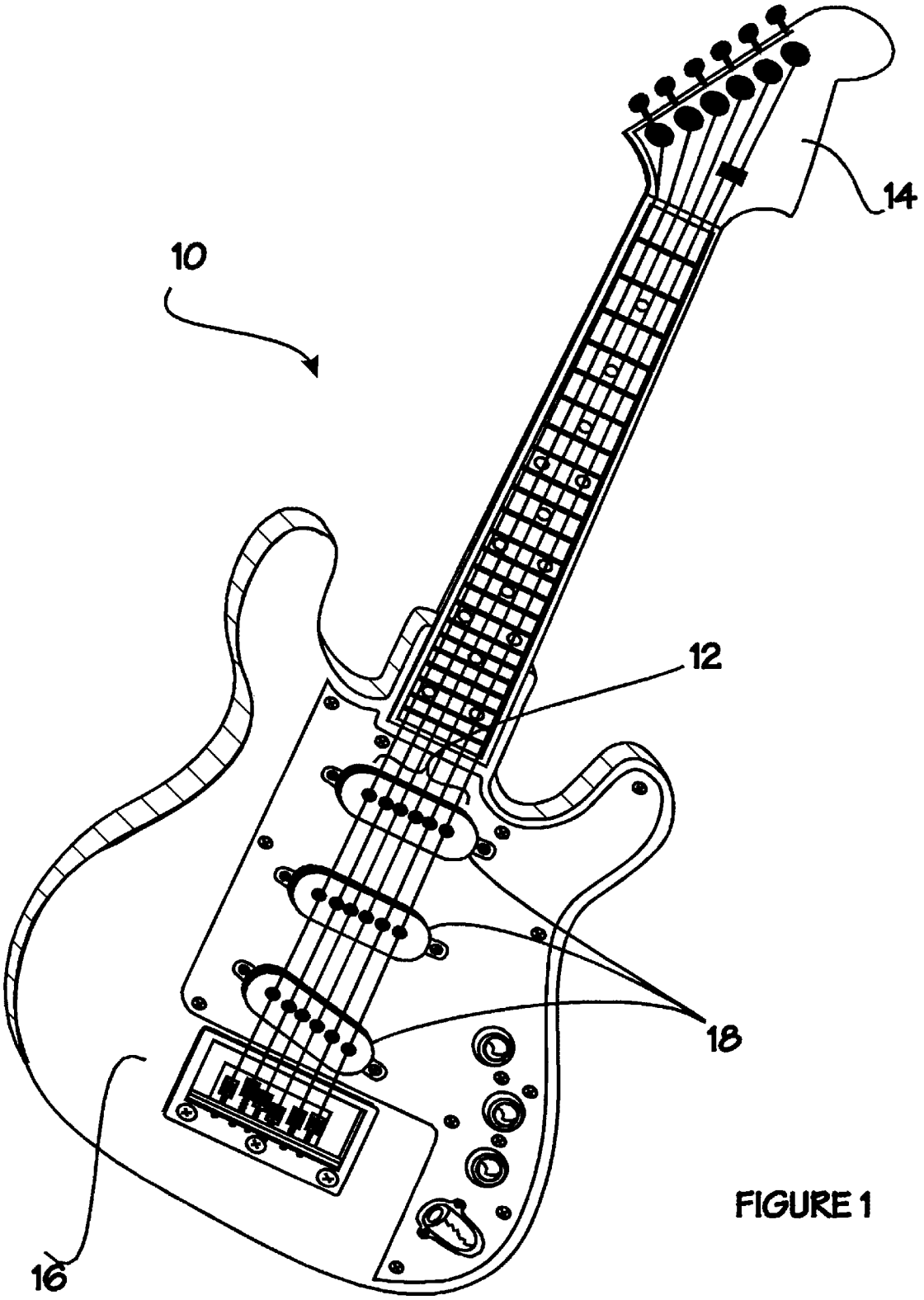
FIG. 1 is a perspective view of a conventional electric guitar.
Figure 2A:
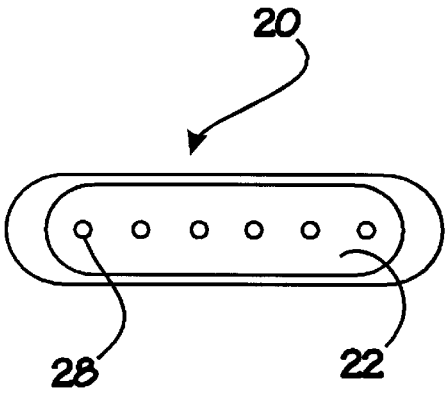
FIGURE 2A Prior Art
FIGS. 2A–2D are a top and side views of conventional single- and dual-coil pickups.
Figure 2B:
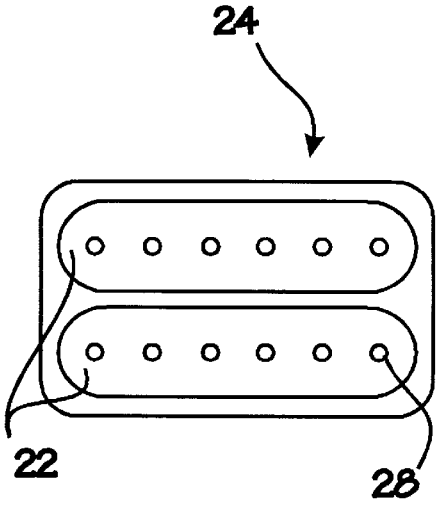
FIGURE 2B Prior Art
Figure 2C:
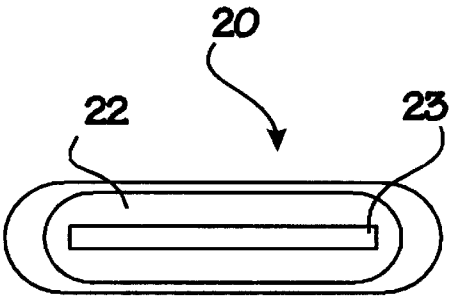
FIGURE 2C Prior Art
Figure 2D:
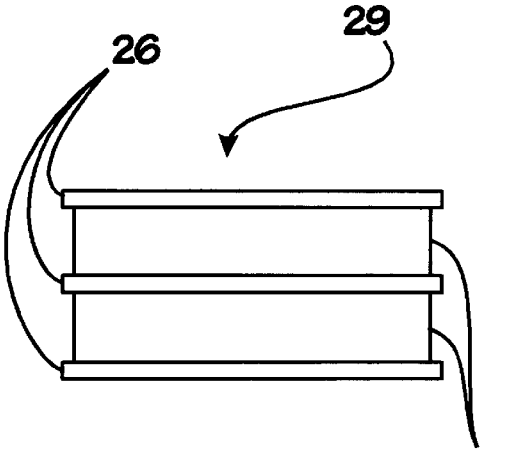
FIGURE 2D Prior Art
Figure 6:
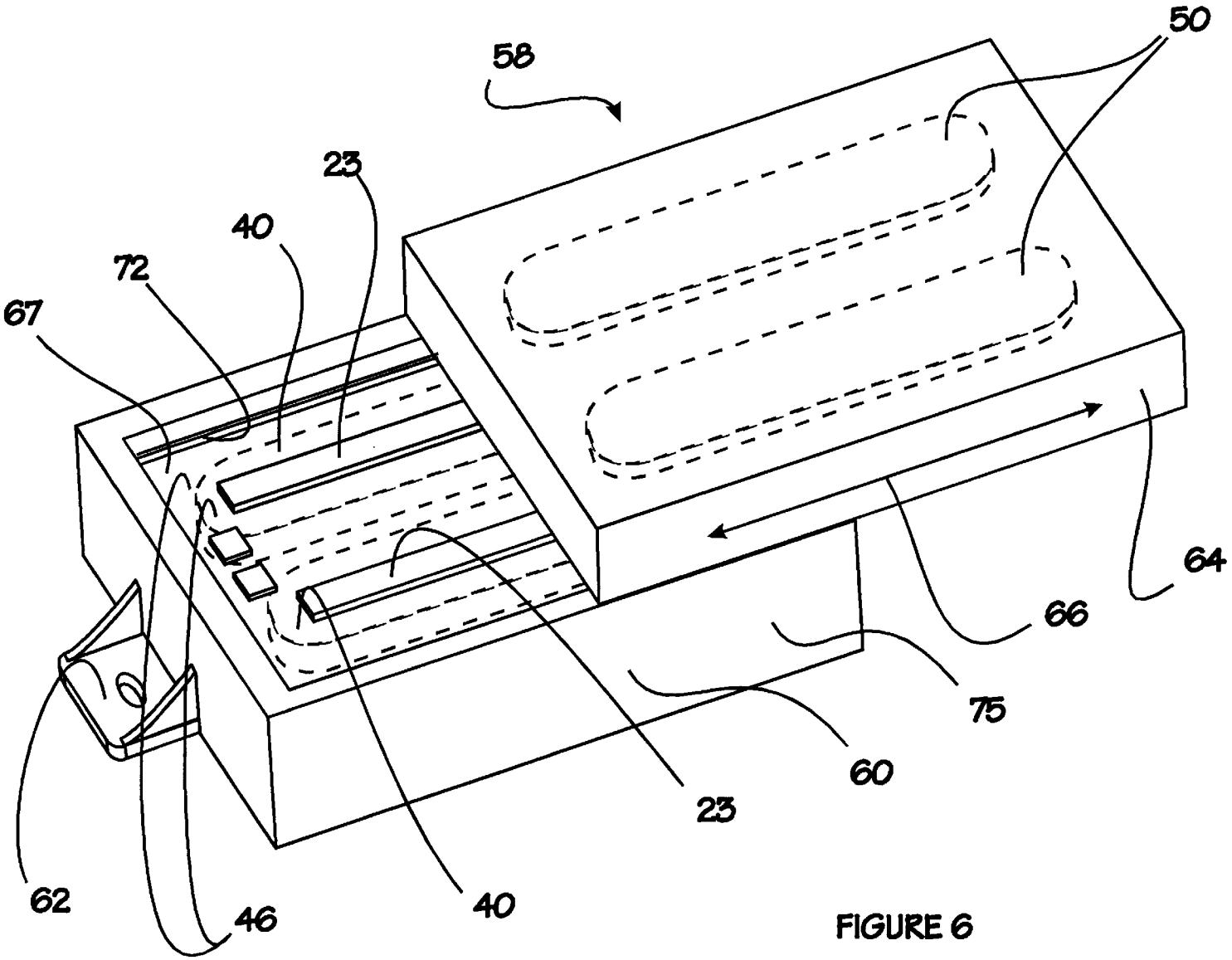
FIG. 6 is a perspective view of a preferred embodiment of a stacked dual coil pickup assembly of the present invention.

FIG. 6 is a perspective view of a preferred embodiment of a stacked dual coil pickup assembly 58 of the present invention. As should be understood, the stacked dual coil pickup assembly 58 is designed to take the place of the conventional dual coil pickup 24 shown in FIG. 2B. In this design, the lower coil assembly 60 contains a pair of lower coils 44 mounted therein, each being electrically connected to a lower winding contact 46. The lower coils 40 are also defined by bar magnets 23 (or pole pieces, depending upon the desired sound characteristics). The lower coil assembly 60 further may include a pair of mounting tabs 62 to attach the lower coil assembly 60 to the guitar face (see FIGS. 4 and 5), either within a recess (see FIGS. 4 and 5) or on the lower face plate 67 itself. The lower coil assembly 60 (and, similarly, the upper coil assembly 64) may be assembled by filling the housing 75 with epoxy or other filler once the face plate 67 and other components are inserted therein. Attachable to the top of the lower coil assembly 60 is an upper coil assembly 64. The upper coil assembly 64 contains a pair of upper coils 50. The upper and lower coils 50 and 60, respectively, are designed as described above in connection with FIG. 5. As also depicted in this figure, the upper coil assembly 64 is preferably engaged and disengaged from the lower coil assembly 60 by sliding it in the direction 66. As previously discussed, therefore, the upper coil assembly 64 can be removed and replaced without removing the strings (see FIGS. 4 and 5).

Other versions or embodiments of the present invention are conceived of; for example, the lower and upper winding contacts 46 and 56 may be metallic pads (as shown herein), or they could also comprise miniature or sub-miniature electronic connectors, such as matched, interlocking male and female "molex" connectors.

Figure 7:
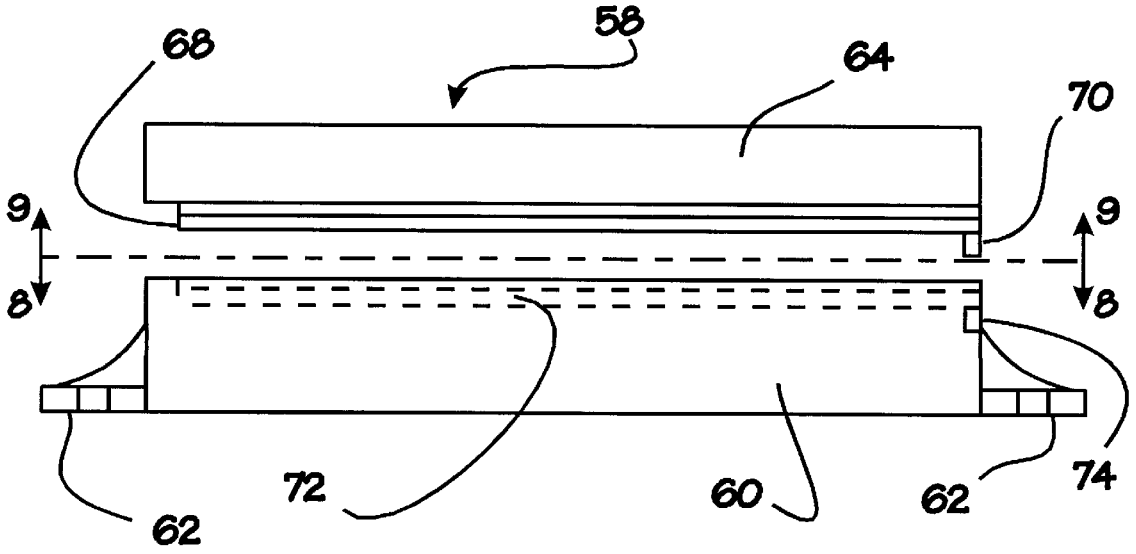
FIG. 7 is a side view of the stacked dual coil pickup assembly of FIG. 6.
Figure 8:
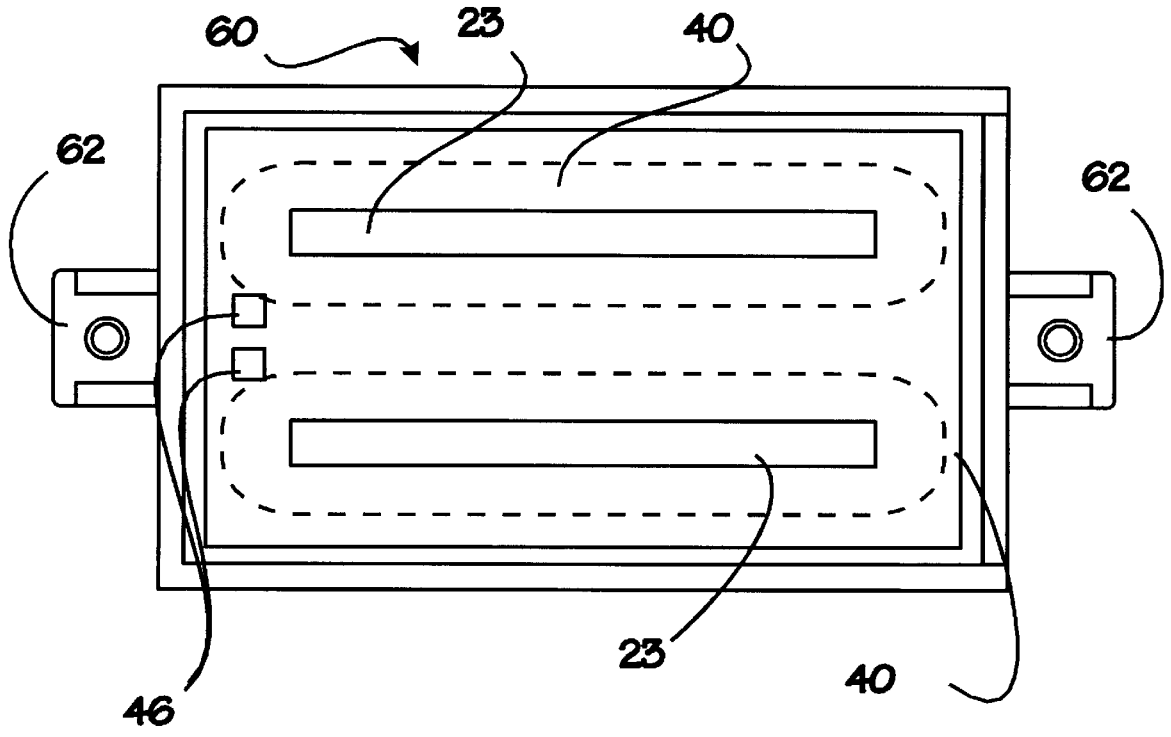
FIG. 8 is a top view of the lower coil assembly of the stacked dual coil pickup assembly of FIGS. 6 and 7.
Figure 9:
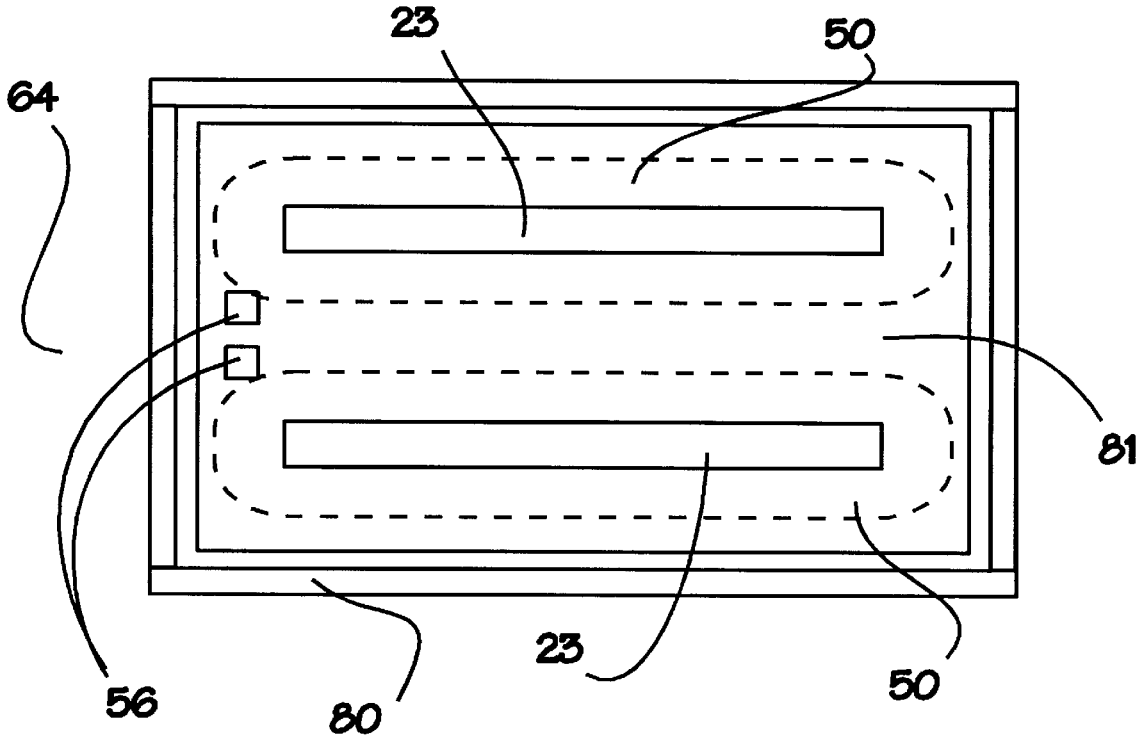
FIG. 9 is a bottom view of the upper coil assembly of the stacked dual coil pickup assembly of FIGS. 6 and 7.

Now turning to FIGS. 7, 8 and 9, we can better understand the upper and lower coil assemblies 64 and 44. FIG. 7 is a side view of the stacked dual coil pickup assembly 58 of FIG. 6, provided to give further detail regarding the means for attaching the upper and lower coil assemblies 44 and 64 to one another. The upper coil assembly 64 is preferably formed with a track 68 running along its length on either side of the assembly 64, with a fin 70 formed at one end. The lower coil assembly 44 includes a groove 72 formed along its length on either side and one end of the assembly 44, that is configured to receive the track 68. To attach the assemblies 44 and 64, one need merely to insert the track 68 into the groove 72 and then slide the upper coil assembly 64 along the lower coil assembly 44 until the depression 74 formed in the lower coil assembly 44 receives the fin 70.

FIG. 8 is a top view of the lower coil assembly 44 of the stacked dual coil pickup assembly 58 of FIG. 7 along the line A—A. The lower coils 44 are enclosed in, and attached to, a lower coil housing 75; the groove (see FIG. 7) is formed along the upper edge of the lower coil housing 75. As can be seen, the preferred mounting tab 62 extending from the lower coil housing 75 may also be defined by an aperture 76 formed therethrough to accept a mounting screw or the like to mount the lower coil assembly 44 to the guitar. Also shown in this figure are the lower winding contacts 46, that are preferably metallic pads attached to the top surface of the lower face plate (see FIG. 6). Each lower winding contact 46 is electrically connected to its respective lower coil 44 (i.e. its windings). Furthermore, the lower coil assembly 44 may be permanently or removeably wired to the other electrical components comprising the guitar's amplification system.

FIG. 9 is a bottom view of the upper coil assembly 64 of the stacked dual coil pickup assembly of FIG. 7 along the line B—B, provided to give further detail regarding this assembly. The pair of upper coils 50 are housed within and attached to the upper coil housing 80. The tracks (see FIG. 7) are formed in the upper coil housing 80 such that they engage the grooves (see FIG. 7) formed within the lower coil housing (see FIG. 8). Also attached to the bottom side of the upper coil housing 80 are the upper winding contacts 56. Like the lower winding contacts (see FIG. 8), the upper winding contacts 56 are preferably metallic pads attached to the housing 80 and electrically connected to their respective upper coil 50 and positioned to connect with the corresponding lower winding contact (see FIG. 8) when the upper coil assembly 64 is slidingly attached to the lower coil assembly (see FIG. 8). Furthermore, as with the lower coil assembly (see FIG. 8), the upper winding contacts 56 are preferably attached to the upper face plate 81.

Figure 10:
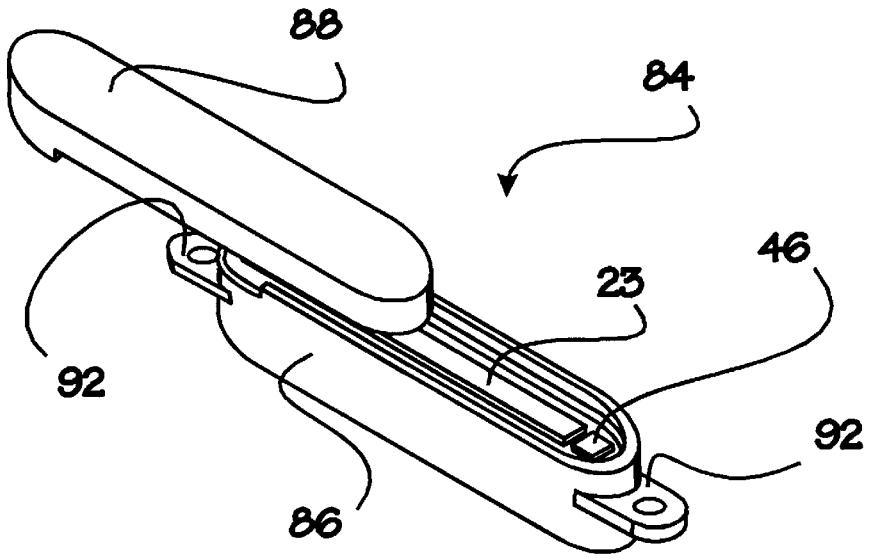
FIG. 10 is a perspective view of a preferred embodiment of the stacked single coil pickup assembly of the present invention.

FIG. 10 indicates how a single coil pickup might be provided by the present invention. FIG. 10 is a perspective view of a preferred embodiment of the stacked single coil pickup assembly 84. Like the dual coil embodiment, the stacked single coil pickup assembly 84 comprises a lower coil assembly 86 that attaches to the stringed instrument, and an upper coil assembly 88 which slidingly attaches to the lower coil assembly 86 such that the upper winding contact (not shown) is placed in electrical contact with the lower winding contact 46. The lower coil assembly 86 may further be defined, as here, by a pair of mounting tabs 92 for attaching the lower coil assembly 86 to the guitar or other stringed instrument.

Figure 11:
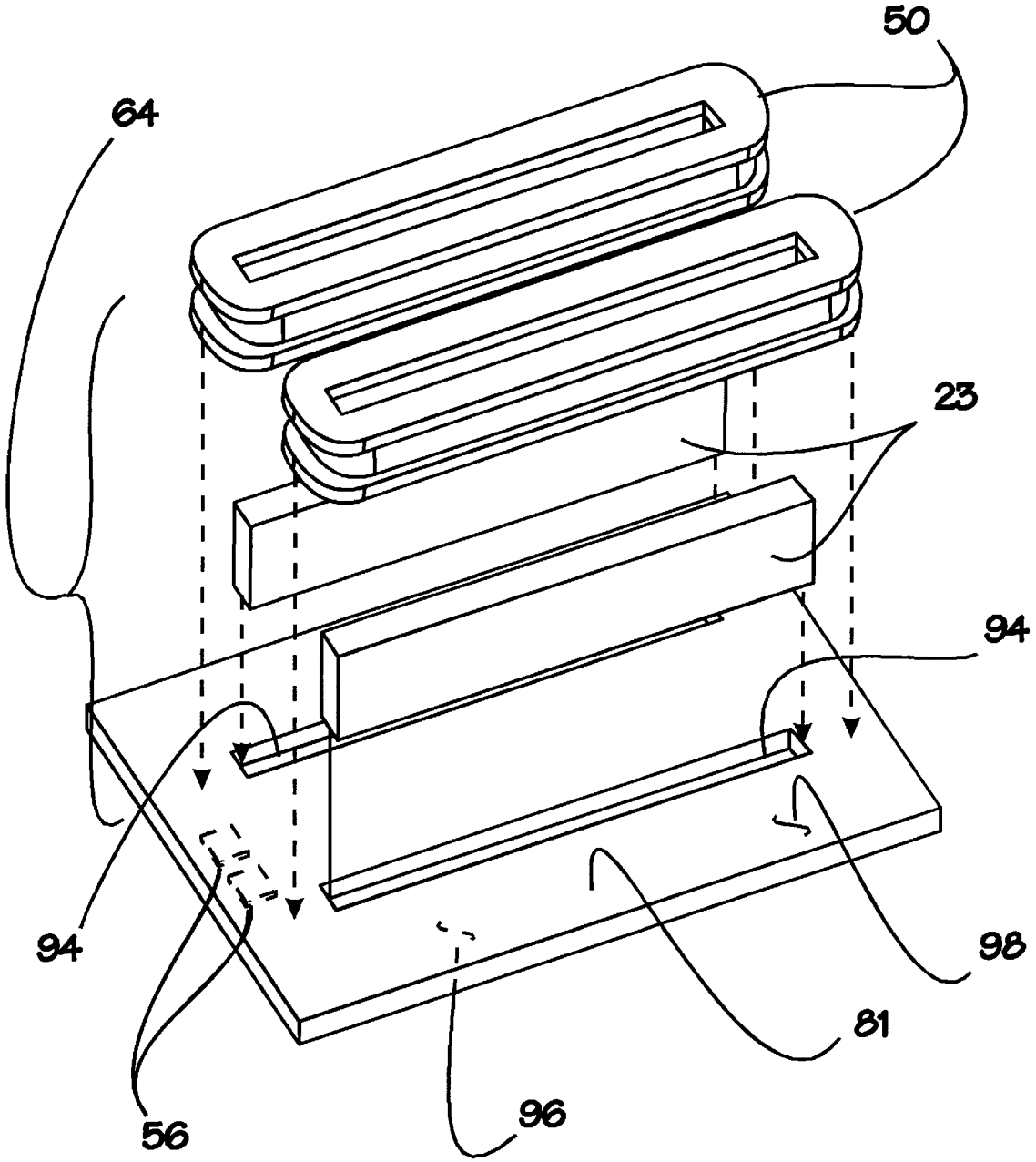
FIG. 11 is a partial exploded perspective view of the upper coil assembly of FIGS. 6, 7 and 9 (excluding the housing).

FIG. 11 gives further detail of the present invention; it is an exploded perspective view of the upper coil assembly 64 of FIGS. 6, 7 and 9 (excluding the housing). The upper face plate 81 comprises a substantially rigid plate having at least one slot 94 configured to accept the bar magnets 23 (or pole pieces) therethrough. In a single coil embodiment, there would be one-half as many slots 94 (or other apertures). The face plate 81 has an outer face 96 and an inner face 98. The upper winding contacts 56 are attached to the outer face 96 of the face plate 81, and configured such that they will contact the lower winding contacts (see above) when the upper coil assembly is attached to the lower coil assembly. The upper face plate 81 may further comprise printed circuits on its surface(s) to provide electrical connection to the various components mounted thereon, as well as to external circuitry. The upper coils 50, as previously discussed, reside over the bar magnets 23 to provide the output current necessary for amplification of the guitar's sound.

It should be apparent that the present invention is an appropriate replacement for virtually any type of current electromagnetic pickup, including both passive and active pickups.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A pickup assembly for stringed instruments, comprising:

a first coil assembly defined by a first coil, said assembly further comprising a first surface; and said first surface defined by at least one first pad in electrical contact with first coil;

a second coil assembly defined by a second coil, said second coil assembly forming an electrical circuit with said first coil assembly to create an electromagnetic field through which said strings pass said second coil assembly further comprising a second surface, said second surface defined by at least one second pad in electrical contact with said second coil, said pads cooperatively configured such that when said second coil assembly is attached to said first coil assembly, said pads and said coils complete a single electrical circuit, said pads and said coil assemblies are further configured to permit said second coil assembly to be detached from said first coil assembly, and whereby said second coil assembly may be exchangeable with an alternate second coil assembly.

2. The pickup assembly of claim 1, wherein:

said first coil assembly comprises a plurality substantially parallel first pole members, said first pole members further being parallel with a pole axis; and said second coil assembly comprises a plurality of substantially parallel second pole members, said second pole members further being substantially parallel with said pole axis.

3. The pickup assembly of claim 2, wherein:

said first pole members are included in said at least one first coil, said first coil being mounted to a first coil housing; and said second pole members are included in said second coil, said second coil being mounted to a second coil housing, said second coil housing being attachable to and detachable from said first coil housing.

4. The pickup assembly of claim 3, wherein:

each said first coil further comprises a pair of insulating plates, said plates attached together to form an insulating frame, and first windings formed by winding wire around each said frame; and each said second coil further comprises a pair of insulating plates, said plates attached together to form an insulating frame, and second windings formed by winding wire around each said frame.

5. The pickup assembly of claim 4, wherein the length of wire comprising said first windings is shorter than the length of wire comprising said second windings.

6. The pickup assembly of claim 4, wherein:

said first coil housing further comprises a pair of parallel grooves adjacent to said first mating surface; and said second coil housing further comprises a pair of parallel tracks, said tracks and grooves being configured to be interlockable.

7. The pickup assembly of claim 4, wherein said first coil assembly is attachable to said stringed instrument and said second coil assembly is slidingly attachable to, and detachable from, said first coil assembly.

8. The pickup assembly of claim 5, wherein said first coil assembly comprises a substantially rectangular first coil housing having a mounting surface opposite to said mating surface and at least two mounting tabs adjacent to said mounting surface.

9. The pickup assembly of claim 5, wherein said second coil assembly comprises a substantially rectangular second coil housing having a fin extending towards said first coil housing.

10. A stacked pickup assembly for guitars, comprising:

a lower coil assembly attachable to said guitar and defined by a first coil, said assembly further comprising a first surface; and said first surface defined by at least one first pad in electrical contact with first coil; and an upper coil assembly defined by a second coil, said second coil assembly forming an electrical circuit with said lower coil assembly to create an electromagnetic field through which said strings pass, said upper coil assembly further comprising a second surface, said second surface defined by at least one second pad in electrical contact with said second coil, said pads cooperatively configured such that when said upper coil assembly is attached to said lower coil assembly, said pads and said coils complete a single electrical circuit, said pads and said coil assemblies are further configured to permit said upper coil assembly to be detached from said lower coil assembly, and whereby said upper coil assembly may be exchangeable with an alternate upper coil assembly.

11. The pickup assembly of claim 10, wherein:

said lower coil assembly comprises at least one lower coil, each said lower coil comprising a plurality substantially parallel lower pole members, said lower pole members further being parallel with a pole axis; and said upper coil assembly comprises at least one upper coil, each said upper coil comprising a plurality of substantially parallel upper pole members, said upper pole members further being substantially parallel with said pole axis.

12. The pickup assembly of claim 11, wherein:

each said lower coil further comprises at least one length of wire, each said length formed into lower windings;

each said upper coil further comprises at least one length of wire, each said length formed into upper windings; and whereby when said upper coil assembly is attached to said lower coil assembly, each said upper windings forms an electrical circuit with one said lower windings.

13. The pickup assembly of claim 12, wherein:

said lower coils are enclosed in a lower coil housing, said lower coil housing further comprising a mating surface defined by at least one pad in electrical contact with said lower windings; and said upper coils are enclosed in an upper coil housing, said upper coil housing further comprising a mating surface defined by at least one pad in electrical contact with one said upper windings said mating surfaces and pads being cooperatively configured such that when said upper housing is attached to said lower housing, each said upper pad and windings forms a single electrical circuit with each said lower pad and windings.

14. The pickup assembly of claim 13, wherein length of wire comprising each said upper windings is a different length than the length of wire comprising each said lower windings.

15. The pickup assembly of claim 14, wherein said upper coil housing is attachable to said stringed instrument and said second coil assembly is slidingly attachable to, and slidingly detachable from, said first coil assembly;

said lower coil housing further comprises a pair of parallel grooves adjacent to said mating surface; and said upper coil housing further comprises a pair of parallel tracks, said tracks and grooves being configured to permit said upper coil housing to slidingly engage said lower coil housing.

16. A stacked electromagnetic pickup system for stringed musical instruments, said assembly permitting exchange of pickup modules while said strings remain attached and in tune, comprising:

a lower coil module attachable to said guitar and defined by a first coil, said module further comprising a first surface; and said first surface defined by at least one first pad in electrical contact with first coil; and a plurality of upper coil modules, each said module defined by a second coil and further comprising a second surface, said second surface defined by at least one second pad in electrical contact with said second coil, said pads cooperatively configured such that when one said upper coil module is attached to said lower coil module, said pads and said coils complete a single electrical circuit, said pads and said coil modules are further configured to permit each said upper coil module to be detached from said lower coil module, and whereby each said upper coil module may be exchangeable with an alternate upper coil module, each said attached upper and lower coil modules forming an electrical circuit and thereby creating an electromagnetic field through which said strings pass.

17. The stacked pickup system of claim 16, wherein each said upper coil module comprises a length of wire forming at least one winding, each said module comprising a different length of wire than said wire length of another said module.

* * * * *